United States Patent [19]

Sonneville

[11] 4,085,556

[45] Apr. 25, 1978

[54] DEVICE FOR ANCHORING FIXING MEANS IN A CONCRETE ELEMENT

[76] Inventor: Roger Paul Sonneville, 5 Rue Maurice Ravel, 92210 Saint-Cloud, France

[21] Appl. No.: 773,557

[22] Filed: Mar. 2, 1977

[30] Foreign Application Priority Data

Mar. 24, 1976 France ..... 76 08530

[51] Int. Cl.[2] ..... E04B 1/38; E04C 3/10

[52] U.S. Cl. ..... 52/223 R; 52/39; 52/494; 52/506; 52/707; 52/710

[58] Field of Search ..... 52/710, 707, 733, 647, 52/704, 39, 223 R, 378, 494, 506

[56] References Cited

U.S. PATENT DOCUMENTS

| | | | |
|---|---|---|---|
| 815,364 | 3/1906 | Mihills | 52/709 X |
| 827,613 | 7/1906 | Brown | 52/707 |
| 868,065 | 10/1907 | Barnes | 52/733 X |
| 874,462 | 12/1907 | Walker | 52/707 |
| 1,114,013 | 10/1914 | Millar | 52/707 X |
| 1,155,243 | 9/1915 | Jordahl | 52/707 X |
| 1,339,226 | 5/1920 | Schuster | 52/737 X |
| 2,121,213 | 6/1938 | Small | 52/704 X |
| 3,114,220 | 12/1963 | Maddox et al. | 52/710 X |

*Primary Examiner*—Alfred C. Perham

*Attorney, Agent, or Firm*—Wenderoth, Lind & Ponack

[57] ABSTRACT

The device comprises, for anchoring each T-shaped fixing bolt in a concrete element, a passageway opening onto an outer face of the element and extended by a cavity which allows rotation of the head of the bolt through 90°. A longitudinal reinforcement which is parallel to the outer face is located at a short distance from the outer face and near to the inner end of the passageways. The reinforcement has in the region of each passageway an opening for the passage of the head of the fixing bolt when this head extends in a direction parallel to the longitudinal axis of the reinforcement. Two retaining surfaces adjoining the opening retain the head of the bolt when it is perpendicular to the longitudinal axis of the reinforcement. Arch-shaped members are fixed to the surface of the reinforcement which is adjacent the outer face of the concrete element and have inclined branches which extend into the concrete in a direction opposed to the outer face to a sufficient depth to distribute the forces within the concrete element.

11 Claims, 7 Drawing Figures

DEVICE FOR ANCHORING FIXING MEANS IN A CONCRETE ELEMENT

The present invention relates to a device for anchoring fixing means in elements or masses of reinforced or prestressed concrete which are subjected to high loads so that the fixing means, such as bolts, are subjected to high stresses.

In the concrete elements, it is often to be feared that the concrete surmounting the anchoring plates of the fixing means partially breaks under the effect of the forces exerted on the fixing means and transmitted by the latter. In order to avoid this, fixing means of great length are usually employed which extend through practically the entire thickness of the concrete element or at least the major part thereof. It is consequently necessary to form deep passageways in the concrete which have an adverse effect on the strength of the whole, since they increase the tendency of the concrete to shear. It is consequently desirable to reduce as far as possible the length of the fixing means or bolts whereby it is possible to reduce also the depth of the passageways formed in the concrete for the introduction and the anchoring of these bolts.

These two requirements appear to be incompatible and present problems which are delicate to solve. It has for example been proposed to place in the concrete a metal reinforcement constituting a complete girder and to fix the fixing means to this reinforcement itself. Such an arrangement presents serious production problems owing to the very fact of the presence of this large and monolithic reinforcement. It is therefore difficult to employ this arrangement.

An object of the present invention is to overcome these drawbacks by providing an anchoring device which is much stronger than those constructed up to the present time and employing short fixing means placed in short passageways.

According to the invention, there is provided a device for anchoring T-shaped fixing means in a concrete element comprising, for each fixing means, a passageway which is perpendicular to the free face of the concrete and opens onto said face and is extended into the concrete by a cavity allowing the rotation of the head of the fixing means through 90°, said device comprising, at a short distance from the free face of the concrete element near to the inner end of the passageways, a longitudinal reinforcement which is parallel to the free face of the concrete and has in the region of each passageway an opening for the passage of the head of the fixing means extending in a direction parallel to the axis of the reinforcement between two surfaces for retaining said head when it extends in a direction perpendicular to the reinforcement, and arch-shaped members fixed to the surface of the reinforcement opposed to the cavity and having lateral branches which extend into the concrete to a relatively great depth well beyond the cavity.

The arch-shaped members transfer the tensile forces exerted on the fixing means to the concrete mass so that the concrete surmounting the reinforcement is no longer subjected to any force tending to pull it away. On the other hand, the arch-shaped members and the reinforcement placed in the vicinity of the free face actively contribute to the resistance to bending of the concrete. With such an arrangement the passageways may be short and the thickness of the concrete above the reinforcement thin. The fixing is ensured in an effective manner.

The following description of embodiments given merely by way of examples and shown in the accompanying drawings will make the advantages and features of the invention more clear.

Figure 1:
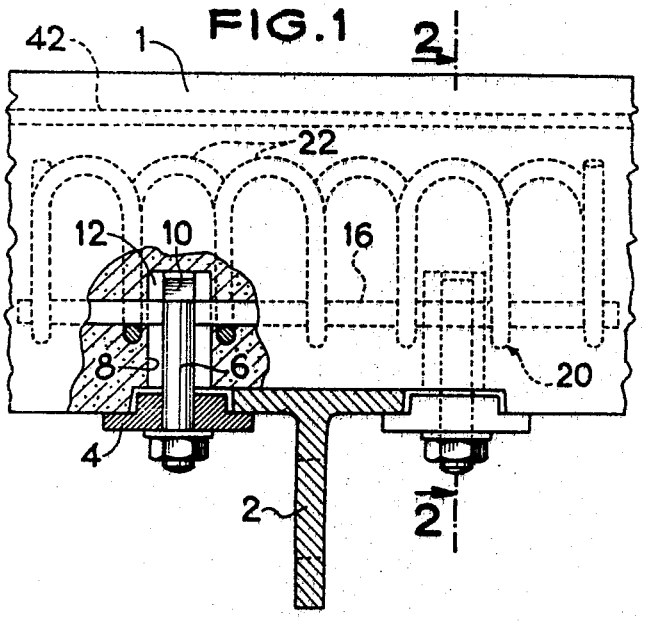
FIG. 1 is a partial side elevational view of a concrete element provided with an anchoring device according to the invention.

Represented in the drawings is an anchoring device in the application thereof to holding means for hooking and suspending a load, but this has been given merely by way of example and it will be obvious that the invention is also applicable to other cases in reinforced or prestressed concrete elements, whenever these elements are intended to support elements maintained by T-shaped fixing means, for example for supports for catenaries, rails of an overhead travelling crane, machine-supporting masses, or the like.

The element shown in FIG. 1 is formed by a concrete element or mass 1 supporting a member 2 maintained by two fasteners 4 which are tightened and fixed against the block 1 by hammer-head bolts or T-shaped bolts 6. Each of the bolts 6 is introduced into a passageway 8 which is perpendicular to the free face 3 of the element and has a rectangular cross-sectional shape and a size slightly larger than that of the head 10 of the bolt, the longer side of which head is disposed perpendicular to the axis of the member 2.

Figure 2:
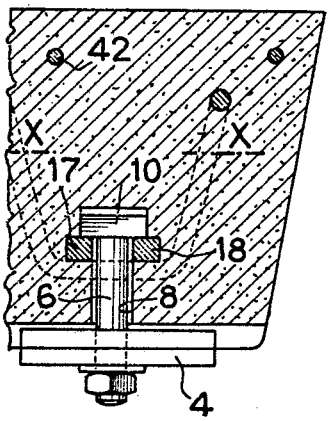
FIG. 2 is a sectional view taken on line 2—2 of FIG. 1.

The passageway 8 is extended at its inner end by a cavity 12 (FIG. 2). The dimension of the cavity 12 is such that the head 10 of the bolt is capable of turning inside the cavity. Placed at the junction between the cavity 12 and the passageway 8 is a longitudinal reinforcement 16 which is parallel to the free face 3 and symmetrical with respect to the plane containing the axes of the two passageways 8.

Figure 3:
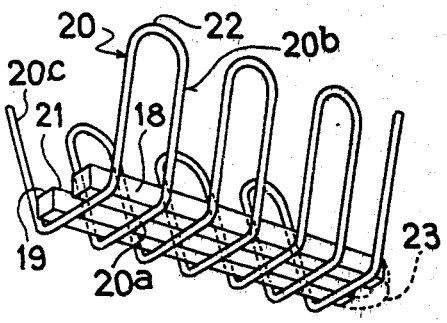
FIG. 3 is a perspective view of the anchoring device alone, according to a first embodiment.

Preferably, the reinforcement 6 is constituted as shown in FIG. 3 by two identical parallel members 17, 18 which are spaced apart a distance slightly greater than the width of the head 10 of the bolt but less than the length of this head. Each of the members has, for example, a rectangular section so as to define a surface 19 constituting a wall of the cavity 12 and performing the function of means for retaining the head 10 within this cavity when the larger dimension of the head 10 extends in a direction parallel to the member 2. The opposite surface 25 of the members 17 and 18 support arch-shaped members 20 comprising a rectilinear branch **20*a* fixed to the two members 17 and 18** parallel to the upper surface of these two members and maintaining the latter at a predetermined constant distance apart.

The branch **20*a* is extended on each side of the reinforcement 16 by two branches 20*b* and 20*c* which are inclined or substantially vertical and extend away from the free face 3 into the concrete wall beyond the level of the cavity 12. When the concrete element is a beam, the branches 20***b* and 20*c* of the arch-shaped members preferably extend beyond the neutral axis of the beam.

It will be clear that the tensile forces exerted on the bolt 6 are transmitted by the reinforcement 16 to the arch-shaped members 20 which transfer them to the mass of concrete and distribute them in the latter. The concrete located in the vicinity of the free face 3 of the concrete between the reinforcement 16 and the member 2 therefore here plays no part and consequently it is not liable to be torn away.

It must be understood that the number and the spacing of the arch-shaped members 20 is a function of their section and of the stiffness, in the direction perpendicular to the free face 3, of the longitudinal members 17 and 18, so that the anchoring can distribute the tensile forces in a sufficiently uniform manner in the concrete. On each side of the passageways 8 the arch-shaped members are spaced apart by a distance which is such that they are located as near as possible to the passageways, the covering of the concrete being just sufficient to preclude their corrosion as is shown clearly in FIG. 1.

Figure 4:
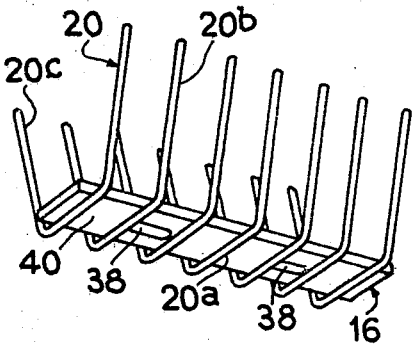
FIG. 4 is a perspective view of an anchoring device according to a second embodiment.

Preferably, the members 20 are spaced apart equal distances from each other and these members are each welded to the two members 17 and 18. The arch-shaped members 20 may be independent from each other as shown in FIG. 4, but may also be constructed in a single piece by folding a steel bar in such manner as to form parallel substantially rectilinear portions which are interconnected by loop portions in accordance with a continuous zig-zag configuration, the parallel portions being thereafter bent around two axes which are parallel and perpendicular to said portions so as to define on each portion a rectilinear central portion 20*a* and two inclined branches 20*c* and 20*b*. The inclined branches are thus united in pairs by the loop portions 22 which complete the resistance in that they ensure a horizontal anchorage to the lower part of the concrete. In this case, it is unnecessary to weld all the rectilinear portions 20*a*, only the end portions are welded to the members 17 and 18 (FIG. 3).

In all cases, the arch-shaped members are preferably made from hard crenelated or ribbed steel so as to have both a high elastic limit and a maximum adherence in the concrete.

Figure 5:
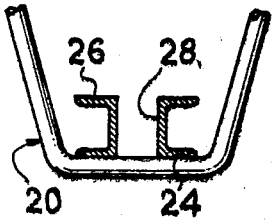
FIGS. 5, 6 and 7 are sectional views of the reinforcement of the anchoring device according to three modifications.

The members 17 and 18 may also be made in a single piece by means of a bar which is bent in the form of a U to form two parallel members 17 and 18 which are interconnected by a curved portion 23 as shown in dotted lines in FIG. 3. Moreover, the members may have sections other than a square or rectangular section, provided they have two surfaces which are parallel to each other: one of the surfaces for retaining the bolt head and the other for maintaining in the concrete. For example, as shown in FIG. 5, these members may have a U-section placed on the side and having a horizontal surface 24 for supporting the arch-shaped members, a surface 26 for abutment against the head of the bolt and a surface 28 interconnecting these two surfaces.

The surface 28 extends the wall of the passageway 8 and the edge of the junction of this surface 28 with the surface 26 forms the bottom of this passageway in the same way as the edge connecting the surface 19 of the members 17 and 18 with the inner surface 21 of these members.

The members 17 and 18 may also be constituted by L-section members and have (FIG. 3) an inner surface 30 for retaining the bolt head and a perpendicular surface 32 to the top of which the arch-shaped members 20 are fixed, the edge 33 between the two surfaces 32 and 30 forming the bottom of the vertical passageway 8.

Figure 6:
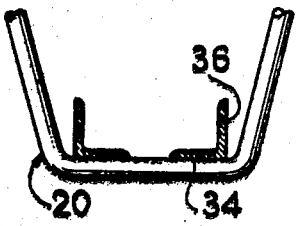
Figure 7:
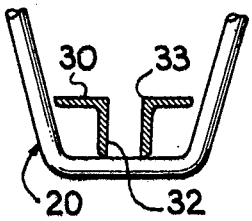

FIG. 6 shows another embodiment in which the L-section members constituting the members 17 and 18 have a flange 34 to which the arch-shaped members 20 are fixed and a flange 36 for maintaining the member in the concrete. In this case, the flanges 34 extend toward each other and their free ends define the passage of introduction of the bolt 6. The bolt head 10 is then applied against the face of the flange 34 remote from the members 20 and the flanges 36 define the cavity 12.

Whatever be the embodiment chosen, the members 17 and 18 always perform the same function and serve as means for retaining the head 10 of the bolts, means for transmitting the forces between the bolts and the arch-shaped members and means for resisting bending and the shearing forces for the whole of the structure.

Likewise, the arch-shaped members, in addition to their deep anchoring function in the concrete, constitute straps which oppose, on one hand, by their horizontal branch 20*a*, the longitudinal cracking and, on the other hand, by the inclined branches 20*c* and 20*b*, the oblique cracking, in particular in the vicinity of the regions weakened by the passageways 8.

According to another embodiment shown in FIG. 4, the reinforcement 16 is constituted by a single member, namely a planar plate 40 which has a rectangular section and is provided, in the region of the passageways 8, with elongate apertures 38, 38, having a length exceeding the length of the heads 10 of the bolts. The plate 40 supports the arch-shaped members 20 in the same way as the members 17 and 18 and performs the same function as the latter.

In this case, as in the preceding cases, the device according to the invention performs not only the function of anchoring the bolts 6 in the concrete but also the function of reinforcing the structure in the regions which are the most stressed in service. If desired, this device may be combined with conventional reinforcements in order to improve the performance of the whole structure. For example, horizontal reinforcements 42 in the form of a grill or zig-zag elements may be placed in the upper part and/or in the lower part of the concrete 1 on each side of the anchoring device. Other reinforcements may also be employed, but they are always placed in such manner as to be sufficiently remote from the arch-shaped members so that the latter remain independent and their ends are free and isolated in the concrete.

Having now described my invention what I claim as new and desire to secure by Letters Patent is:

1. An assembly comprising a concrete element having an outer face, a structure to be clamped against said outer face, and a device for clamping said structure to said outer face and comprising at least two substantially T-shaped fixing means having a head and located in a plane and on opposite sides of said structure, the concrete element comprising, for each fixing means, a passageway in the element and opening onto the outer face of the element, a cavity in the element and allowing the rotation of the head of the corresponding fixing means through 90° and extending the passageway, a longitudinal reinforcement having a longitudinal axis which is substantially parallel to the outer face and substantially parallel to said plane and located at a short distance from the outer face of the concrete element and near to an inner end of the passageways, the reinforcement defining, in the region of each passageway, an opening for the passage of the head of the corresponding fixing means when said head extends in a direction parallel to the longitudinal axis of the reinforcement and the reinforcement defining surfaces for engaging and retaining the heads of the fixing means adjacent said openings for retaining the heads when they are perpendicular to said longitudinal axis of the reinforcement, and arch-shaped members which are fixed to a surface of the reinforcement adjacent the outer face of the concrete element and have inclined branches which extend into the concrete in a direction opposed to said outer face to a sufficient depth and arranged substantially symmetrically relative to said longitudinal axis to distribute the forces within the concrete element, the fixing means having, in a region of the fixing means remote from said head, means defining surfaces which are in bearing relation to said structure and to said outer face of said element for retaining said structure against said outer face of the element.

2. The assembly claimed in claim 1, wherein the reinforcement comprises two members which are parallel and disposed symmetrically with respect to said plane and spaced apart a distance which exceeds the width of the head of each fixing means but is less than the length of the head of each fixing means.

3. The assembly claimed in claim 2, wherein a curved portion interconnects the two members to constitute a U-shaped member in one piece.

4. The assembly claimed in claim 1, wherein a curved portion in the shape of an arc of a circle interconnects the arch-shaped members in pairs.

5. The assembly claimed in claim 1, wherein the arch-shaped members are spaced apart from each other a distance exceeding the width of the passageways.

6. The assembly claimed in claim 1, wherein all the arch-shaped members are made in a single piece comprising parallel rectilinear portions interconnected by curved portions and bent around two axes which are perpendicular to the parallel portions and spaced apart from each other a distance substantially corresponding to the width of the reinforcement.

7. The assembly claimed in claim 1, wherein the members of the reinforcement have a rectangular cross-sectional shape.

8. The assembly claimed in claim 1, wherein the members of the reinforcement are L-section members.

9. The assembly claimed in claim 1, wherein the members of the reinforcement are U-section members disposed in back-to-back relation.

10. The assembly claimed in claim 1, wherein the reinforcement comprises a plate having a rectangular cross-sectional shape, said openings for the passage of the heads of the fixing means being elongate apertures in the plate.

11. The assembly claimed in claim 1, wherein the concrete element is a beam and the branches of the arch-shaped members extend beyond the neutral axis of the beam.

* * * * *